US011826977B2

(12) United States Patent
Fujita et al.

(10) Patent No.: US 11,826,977 B2
(45) Date of Patent: Nov. 28, 2023

(54) TRANSFER DEVICE AND METHOD FOR CONTROLLING TRANSFER DEVICE

(71) Applicant: AIDA ENGINEERING, LTD., Kanagawa (JP)

(72) Inventors: Ken Fujita, Machida (JP); Sotoyuki Kaneko, Sagamihara (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 425 days.

(21) Appl. No.: 17/338,363

(22) Filed: Jun. 3, 2021

(65) Prior Publication Data

US 2021/0379856 A1 Dec. 9, 2021

(30) Foreign Application Priority Data

Jun. 9, 2020 (JP) ..... 2020-100212

(51) Int. Cl.
*B21D 43/04* (2006.01)
*B30B 15/14* (2006.01)

(52) U.S. Cl.
CPC ..... *B30B 15/148* (2013.01); *B21D 43/04* (2013.01)

(58) Field of Classification Search
CPC ..... B30B 15/148; B30B 15/32; B30B 15/00; B21D 43/04; B21D 43/055; B65G 43/00; B65G 47/901
See application file for complete search history.

(56) References Cited

U.S. PATENT DOCUMENTS

2008/0295564 A1 12/2008 Kaneko et al.
2013/0104613 A1 5/2013 Kaneko et al.

FOREIGN PATENT DOCUMENTS

JP 2013-091078 A 5/2013

OTHER PUBLICATIONS

Extended European Search Report issued in corresponding EP Application No. 21174962.7, dated Nov. 3, 2021.

*Primary Examiner* — Michael W Choi
(74) *Attorney, Agent, or Firm* — McDermott Will & Emery LLP

(57) ABSTRACT

A transfer device transfers a workpiece by a transfer motion which is based on a transfer individual phase signal synchronized with a master phase signal, and includes: a setting unit that sets a point on a trajectory of a transfer bar as a switching point of a timing switch, the point on the trajectory being separated from a reference point on the trajectory by a designated distance designated by a user, and the trajectory being based on the transfer motion; and a signal output unit that outputs a timing signal to an external device at a timing when the transfer bar reaches the switching point.

6 Claims, 7 Drawing Sheets

TRANSFER DEVICE AND METHOD FOR CONTROLLING TRANSFER DEVICE

CROSS-REFERENCE TO RELATED APPLICATION

Japanese Patent Application No. 2020-100212, filed on Jun. 9, 2020, is hereby incorporated by reference in its entirety.

BACKGROUND

The present invention relates to a transfer device and a method for controlling the transfer device.

A transfer press system is constituted of a press machine that performs press working and a transfer device that transfers a workpiece (material). The press machine is classified into a conventional mechanical press machine that uses mechanisms such as gears and cams to drive a press, and a servo press machine that uses a servo motor that has been developed in recent years. Similarly, the transfer device is classified into a mechanical transfer device that mechanically operates in conjunction with a crank angle (press angle) of the press, and a servo transfer device that uses the servo motor that has been developed in recent years. With the advent of the servo press machine, for example, it has become possible to set complex motions that could not be set with the conventional mechanical press by controlling the servo motor by setting the speed and position during processing with numerical values, such as operating at high speed up to the middle of press working and slowing down near the bottom dead center (the lowest point of pressurization), and by switching the rotation direction of the servo motor and repeatedly reversing the crankshaft, reciprocating the slide (forward and reverse motions) only near the bottom dead center. As a result, it has become possible to achieve the press working with both high quality and high productivity.

In the conventional transfer press system, a start point and an end point of each of motions (advance motion and return motion) on an X-axis (feed direction), a start point and an end point of each of motions (clamp motion and unclamp motion) on a Y-axis (clamp direction), and a start point and an end point of each of motions (lift motion and down motion) on a Z-axis (lift direction) were assigned according to the press angle, so that the motion of a transfer bar (transfer motion) of the transfer device was linked to the motion of the press machine. Therefore, in the case of the transfer press system using the servo press machine, even when the transfer device is equipped with the servo motor to set a free transfer motion, as long as the transfer motion operates in conjunction with the press angle, the motion of the transfer device is also affected by acceleration/deceleration, rotation direction of the press, or the like, and the stable transfer motion was not possible. To solve this problem, instead of linking the motions of the press machine and the transfer device with the press angle when using the servo transfer device in the transfer press system having the servo press machine, a servo transfer press system that operates with the optimal transfer motion for freely setting a press motion was invented in which the servo press machine performs press operation with the press motion based on a press individual phase signal, the servo transfer device performs transfer operation with the transfer motion based on a transfer individual phase signal, and the servo press machine and the servo transfer device are controlled by synchronizing the respective phase signals with the master phase signal while adjusting the timing and phase so that the servo press machine and the servo transfer device do not interfere with each other (JP 2013-91078 A).

In the conventional transfer press system, a point at which a timing switch is switched on or off (a point at which a timing signal is outputted to an external device) is set by designating the crank angle (press angle) of the press machine at on or off, as illustrated in FIG. 17. In the example illustrated in FIG. 17, an off timing signal is outputted when the press angle is 65°, and an on timing signal is outputted when the press angle is 295°. In the case of the mechanical transfer press system, the movement of the transfer bar (transfer motion) of the transfer device is also linked to the press angle of the press machine, so the position of the switching point of the timing switch for the transfer motion can also be set by the press angle. However, in the case of the servo transfer press system in which the servo press machine and the transfer feeder operate with different individual phase signals, the transfer motion is not directly linked to the press angle, so that it is not possible to set the timing switch according to the transfer motion.

SUMMARY

The invention can provide a transfer device capable of setting a switching point of a timing switch according to the movement of a transfer bar of the transfer device, and a method for controlling the transfer device.

According to a first aspect of the invention, there is provided a transfer device that transfers a workpiece by a transfer motion which is based on a transfer individual phase signal synchronized with a master phase signal, the transfer device including:

a setting unit that sets a point on a trajectory of a transfer bar as a switching point of a timing switch, the point on the trajectory being separated from a reference point on the trajectory by a designated distance designated by a user, and the trajectory being based on the transfer motion; and a signal output unit that outputs a timing signal to an external device at a timing when the transfer bar reaches the switching point.

According to a second aspect of the invention, there is provided a method for controlling a transfer device that transfers a workpiece by a transfer motion which is based on a transfer individual phase signal synchronized with a master phase signal, the method including:

a setting step that sets a point on a trajectory of a transfer bar as a switching point of a timing switch, the point on the trajectory being separated from a reference point on the trajectory by a designated distance designated by a user, and the trajectory being based on the transfer motion; and a signal output step that outputs a timing signal to an external device at a timing when the transfer bar reaches the switching point.

Figure 1:
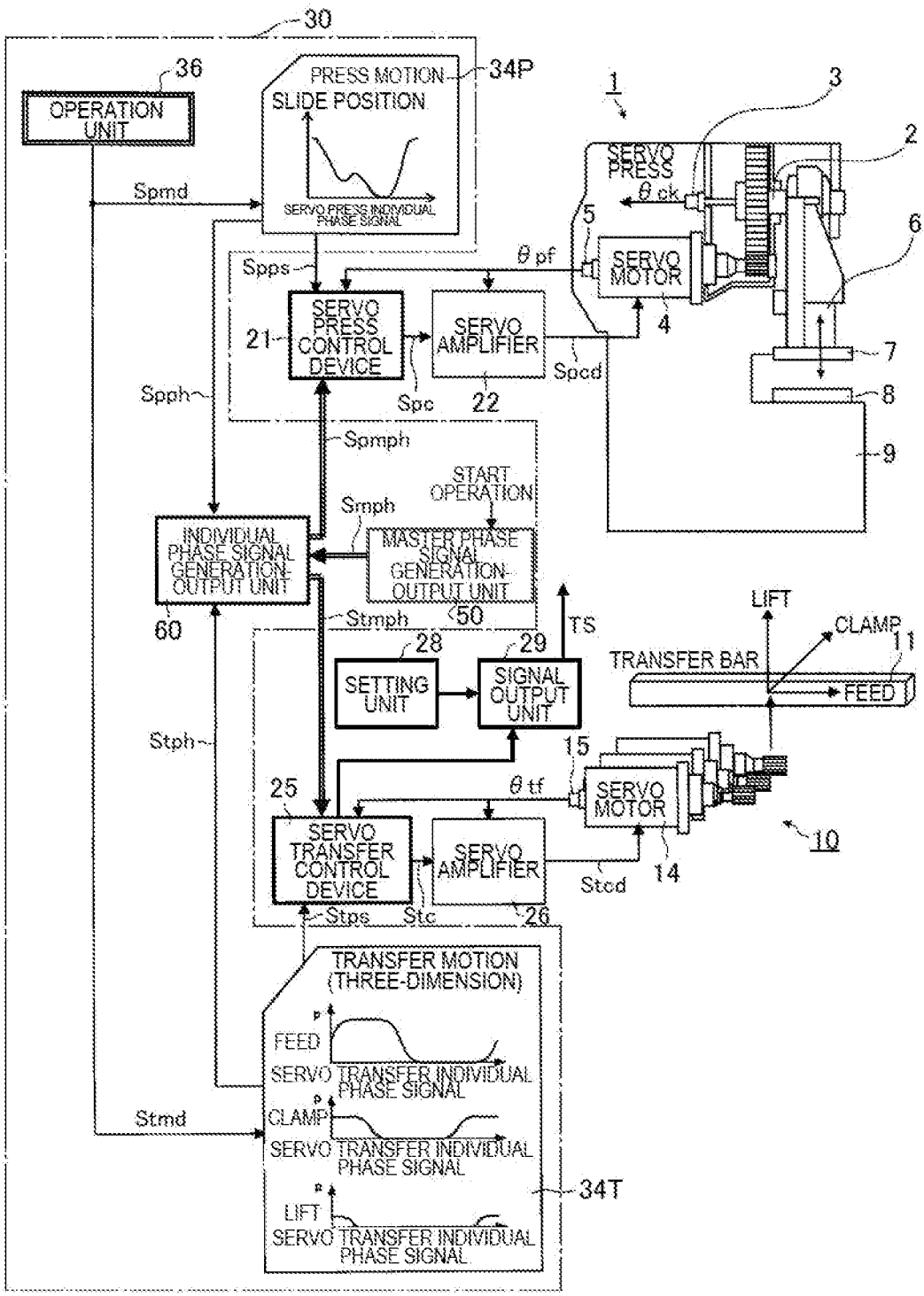
FIG. 1 is a block diagram of a servo transfer press system including a transfer device according to an embodiment of the invention.

DESCRIPTION OF EMBODIMENTS (1) According to an embodiment of the invention, there is provided a transfer device that transfers a workpiece by a transfer motion which is based on a transfer individual phase signal synchronized with a master phase signal, the transfer device including:

a setting unit that sets a point on a trajectory of a transfer bar as a switching point of a timing switch, the point on the trajectory being separated from a reference point on the trajectory by a designated distance designated by a use, and the trajectory being based on the transfer motion; and a signal output unit that outputs a timing signal to an external device at a timing when the transfer bar reaches the switching point.

Further, according to an embodiment of the invention, there is provided a method for controlling a transfer device that transfers a work-piece by a transfer motion which is based on a transfer individual phase signal synchronized with a master phase signal, the method including:

a setting step that sets a point on a trajectory of a transfer bar as a switching point of a timing switch, the point on the trajectory being separated from a reference point on the trajectory by a designated distance designated by a user, and the trajectory being based on the transfer motion; and a signal output step that outputs a timing signal to an external device at a timing when the transfer bar reaches the switching point.

According to the transfer device and the method for controlling the transfer device, since the switching point of the timing switch can be set by designating a distance from the reference point on the trajectory of the transfer bar without using a parameter (press angle) of the other device, the switching point of the timing switch can be easily and intuitively set while adjusting the timing in consideration of the movement of the transfer bar.

(2) In the transfer device and the method for controlling the transfer device, the transfer motion may be formed of a combination of an unclamp motion, a return motion, a clamp motion, a lift motion, an advance motion, and a down motion of the transfer bar, and the reference point may be a point at which a motion of the transfer bar is changed.

According to the transfer device and the method for controlling the transfer device, by setting a point at which the motion of the transfer bar is changed (a point changing from the clamp motion to the lift motion, from the lift motion to the advance motion, from the advance motion to the down motion, from the down motion to the unclamp motion, from the unclamp motion to the return motion, or from the return motion to the clamp motion) as a start point of a distance (reference point) when setting the switching point of the timing switch, it is basically possible to avoid changing the setting value (designated distance) of the switching point of the timing switch, even when the transfer motion is changed.

(3) In the transfer device, when an overlap section in which the transfer bar moves in a first direction and a second direction among a feed direction, a clamp direction, and a lift direction at the same time by starting a motion in the second direction before completing a motion in the first direction is set between the reference point and the switching point, the setting unit may set a point separated from the reference point by the designated distance on the trajectory when the overlap section is not set as the switching point.

In the method for controlling the transfer device, in the setting step, when an overlap section in which the transfer bar moves in a first direction and a second direction among a feed direction, a clamp direction, and a lift direction at the same time by starting a motion in the second direction before completing a motion in the first direction is set between the reference point and the switching point, a point separated from the reference point by the designated distance on the trajectory when the overlap section is not set may be set as the switching point.

According to the transfer device and the method for controlling the transfer device, even when a length of the overlap section (overlap amount) is changed, it is not necessary to change the set value (designated distance) of the switching point of the timing switch.

(4) In the transfer device, when an overlap section is set in which the transfer bar moves in a first direction and a second direction among a feed direction, a clamp direction, and a lift direction at the same time by starting a motion in the second direction before completing a motion in the first direction, and the reference point is within the overlap section, a point which is on the trajectory and separated from the reference point by the designated distance in the second direction as the switching point.

In the method for controlling the transfer device, in the setting step, when an overlap section is set in which the transfer bar moves in a first direction and a second direction among a feed direction, a clamp direction, and a lift direction at the same time by starting a motion in the second direction before completing a motion in the first direction, and the reference point is within the overlap section, a point which is on the trajectory and separated from the reference point by the designated distance in the second direction may be set as the switching point.

(5) In the transfer device, when an overlap section is set in which the transfer bar moves in a first direction and a second direction among a feed direction, a clamp direction, and a lift direction at the same time by starting a motion in the second direction before completing a motion in the first direction, and the switching point is set within the overlap section, the setting unit may set a point which is on the trajectory and separated from the reference point by the designated distance in the first direction as the switching point.

In the method for controlling the transfer device, in the setting step, when an overlap section is set in which the transfer bar moves in a first direction and a second direction among a feed direction, a clamp direction, and a lift direction at the same time by starting a motion in the second direction before completing a motion in the first direction, and the switching point is set within the overlap section, a point which is on the trajectory and separated from the reference point by the designated distance in the first direction may be set as the switching point.

Below, embodiments according to the invention will be described in detail with reference to the drawings.

Figure 2:
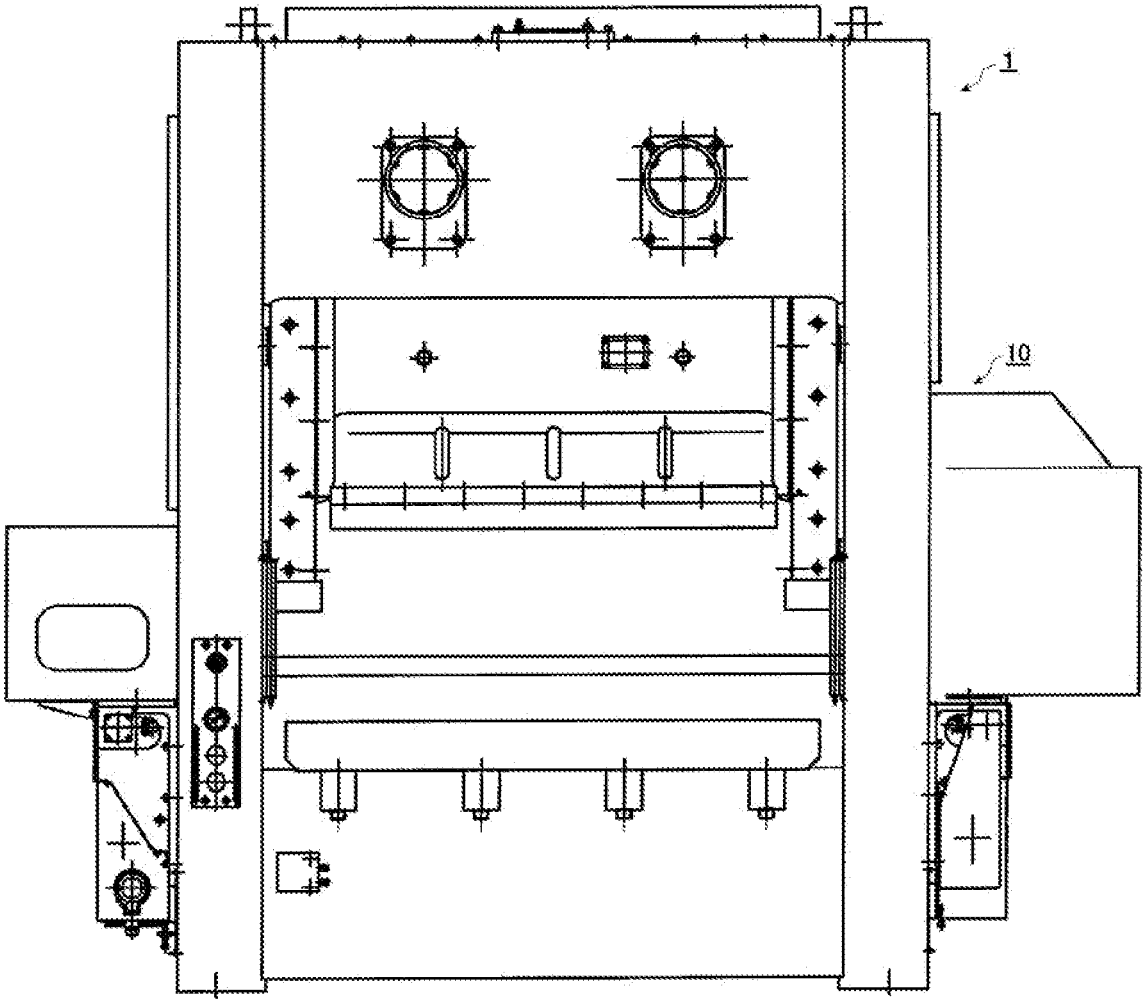
FIG. 2 is a front view of a servo press machine.

FIG. 1 is a block diagram of a servo transfer press system including a transfer device according to an embodiment of the invention. The servo transfer press system includes a servo press machine 1 for press working, a servo transfer device 10 (transfer device) for transferring a workpiece, and a transfer press operation control device 30. FIG. 2 is a front view of the servo press machine 1.

In the servo press machine 1, a slide 6 vertically guided in a main body 9 is moved upward and downward by a slide drive mechanism (including a crankshaft 2 and the like). An upper die 7 is secured on the slide 6, and a lower die 8 is secured on a bolster (bed). The crankshaft 2 is driven to rotate by a servo motor 4 via a gear mechanism. The crankshaft 2 is provided with a crankshaft encoder 3 that detects a rotation angle (press angle) of the crankshaft 2. A rotation angle detection signal θck of the crankshaft encoder 3 is inputted to the transfer press operation control device 30. By processing the rotation angle detection signal θck, a press speed and a current vertical position of the slide 6 (bottom dead center position and the like) can be detected. The servo motor 4 is provided with a motor encoder 5. A rotation angle detection signal θpf from the motor encoder 5 is inputted to a servo press control device 21 and a servo amplifier 22 for servo press control, and is also inputted to the transfer press operation control device 30.

The servo transfer device 10 is driven to transfer a pair of left and right transfer bars 11 by a plurality (here, three as an example) of servo motors 14 (14*a*, 14*b*, and 14*c*). Note that the servo transfer device 10 may be driven by two servo motors. The transfer bar 11 is provided with a tool (finger, claw-shaped member, vacuum cup, or the like) for clamping a workpiece. In the present embodiment, the finger is secured on the transfer bar 11. The transfer bar 11 is operated while partially overlapping an unclamp motion, a return motion, a clamp motion, a lift motion, an advance motion, and a down motion. The transfer bar 11 performs motions in a feed direction (return motion and advance motion) by the servo motor 14*a*, performs motions in a clamp direction (unclamp motion and clamp motion) by the servo motor 14*b*, and performs motions in a lift direction (lift motion and down motion) by the servo motor 14*c*. Each of the servo motors 14 is provided with a motor encoder 15. A rotation angle detection signal θtf from the motor encoder 15 is inputted to a servo transfer control device 25 and a servo amplifier 26 for servo transfer control, and is also inputted to the transfer press operation control device 30.

The transfer press operation control device 30 includes a press motion storage unit 34P, a transfer motion storage unit 34T, an operation unit 36, a master phase signal generation-output unit 50, and an individual phase signal generation-output unit 60.

A user (operator) uses the operation unit 36 to input data Spmd for achieving an optimal press motion for press working. The image of the press motion is represented in a graphical format in which a horizontal axis represents the value of the press individual phase signal (for example, the value from 0° to 360°) and a vertical axis represents a slide position. The data Spud is subjected to a smoothing process or the like, and is stored in the press motion storage unit 34P as an image-like press motion. The stored press motion is supplied to the servo press control device 21 and the individual phase signal generation-output unit 60.

Similarly, the user uses the operation unit 36 to input data Stmd for achieving an optimal transfer motion for the workpiece transfer. The image of transfer motion data is represented in a graphical format in which the horizontal axis represents a value of the transfer individual phase signal (for example, a value from 0° to 360°), and the vertical axis represents a three-dimensional position of the transfer bar 11 (the position in the feed direction (X-axis direction), the clamp direction (Y-axis direction), and the lift direction (Z-axis direction)). The data Stmd is subjected to the smoothing process or the like, and is stored in the transfer motion storage unit 34T as an image-like transfer motion. The stored transfer motion is supplied to the servo transfer control device 25 and the individual phase signal generation-output unit 60.

The master phase signal generation-output unit 50 generates a master phase signal Smph using a clock signal outputted from an oscillation circuit in a CPU and outputs the generated master phase signal Smph to the individual phase signal generation-output unit 60. When the transfer press operation is started, the value of the master phase signal Smph repeatedly increases from 0° to 360°.

The individual phase signal generation-output unit 60 generates a press individual phase signal Spmph synchronized with the master phase signal Smph from the inputted master phase signal Smph aid a phase signal Spph based on the stored press motion, and outputs the generated press individual phase signal Spmph to the servo press control device 21. Similarly, the individual phase signal generation-output unit 60 generates a transfer individual phase signal Stmph synchronized with the master phase signal Smph from the inputted master phase signal Smph and a phase signal Stph based on the stored transfer motion, and outputs the generated transfer individual phase signal Stwph to the servo transfer control device 25.

The servo press control device 21 generates a press control signal Spc for matching an actual crank angle with a calculated crank target angle while referring to the press individual phase signal Spmph and the rotation angle detection signal θpf. The calculated crank target angle is calculated as a crank target angle that uniquely and mechanically corresponds to the current slide target position obtained from the press motion (slide position data Spps). The generated press control signal Spc is amplified by the servo amplifier 22, and used to drive (rotate) the servo motor 4 as a press drive signal Spcd.

The servo transfer control device 25 generates a transfer control signal Stc for matching an actual motor angle with a calculated motor target angle while referring to the transfer individual phase signal Stmph and the rotation angle detection signal θtf. The calculated motor target angle is calculated as a servo motor target angle for feed, clamp, and lift that uniquely and mechanically corresponds to the current target position of the transfer bar 11 (the feed target position, the clamp target position, or the lift target position) obtained from the transfer motion (transfer position data Stps). The generated transfer control signal Stc is amplified by the servo amplifier 26, and used to drive (rotate) the servo motor 14 as a transfer drive signal Stcd.

The servo transfer device 10 includes a setting unit 28 and a signal output unit 29. The functions of the setting unit 28 and the signal output unit 29 are enabled by hardware such as a processing unit (CPU) and an input/output interface provided in the servo transfer device 10, and software such as a program stored in a storage unit provided in the servo transfer device 10.

The setting unit 28 sets, based on the operation input to the operation unit 36 by the user, a point on a trajectory (movement trajectory) of the transfer bar 11 based on the transfer motion that is separated from a reference point on the trajectory by a distance designated by the user as a switching point of the timing switch. The reference point is, for example, a point at which the motion (unclamp motion, return motion, clamp motion, lift motion, advance motion, or down motion) of the transfer bar 11 is changed.

The signal output unit 29 acquires the current position of the transfer bar 11 (the three-dimensional position of the transfer bar 11 obtained from the actual motor angles of the feed, clamp, and lift, and the like) based on the signal from the servo transfer control device 25 or the like, and outputs the timing signal TS (an on signal or an off signal) to an external device at the timing when the transfer bar 11 reaches the switching point set on the trajectory. The external device includes, for example, a gripping failure detection device that detects that finger of the transfer bar 11 does not hold the workpiece (gripping failure), and an external transfer device. For example, in a case that the timing signal TS is outputted to the gripping failure detection device, the gripping failure detection device starts detecting the gripping failure when the gripping failure detection device receives the on signal from the signal output unit 29, and stops detecting the gripping failure when the gripping failure detection device receives the off signal from the signal output unit 29.

Figure 3:
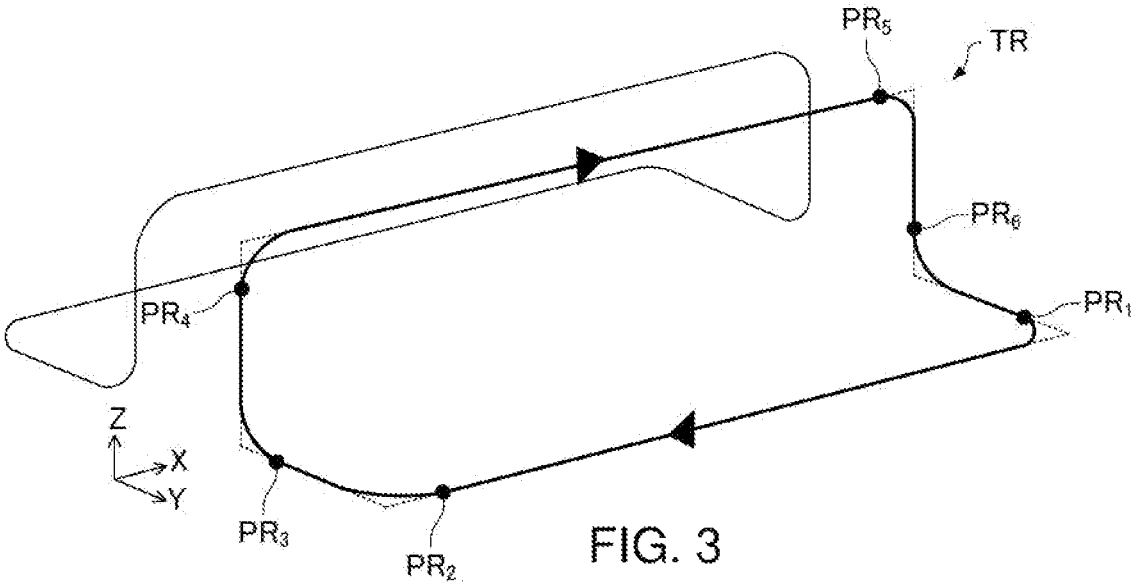
FIG. 3 is a diagram illustrating a trajectory of a transfer bar based on a transfer motion.

FIG. 3 is a diagram illustrating the trajectory of the transfer bar 11 based on the transfer motion. Hereinafter, the trajectory of one of a pair of right and left transfer bars 11 will be described, but the same applies to another trajectory. In the present embodiment, reference points PR ($PR_1$ to $PR_6$) are set at points where the motion of the transfer bar 11 is changed on the trajectory TR of the transfer bar 11. The reference point PR is a point that serves as a reference (start point of a designated distance) when setting the switching point of the timing switch. More specifically, on the trajectory TR, the reference point $PR_1$ is set at the start point of the return motion (motion to move the return route in the X-axis direction), the reference point $PR_2$ is set at the start point of the clamp motion (motion to move in the Y-axis direction and attach the finger to the workpiece), the reference point $PR_3$ is set at the start point of the lift motion (motion to move upward in the Z-axis direction), the reference point $PR_4$ is set at the start of the advance motion (motion to move outward in the X-axis direction), the reference point $PR_5$ is set at the start point of the down motion (motion to move downward in the Z-axis direction), and the reference point $PR_6$ is set at the start point of the unclamp motion (motion to move in the Y-axis direction and separate the finger from the workpiece).

Figure 4:
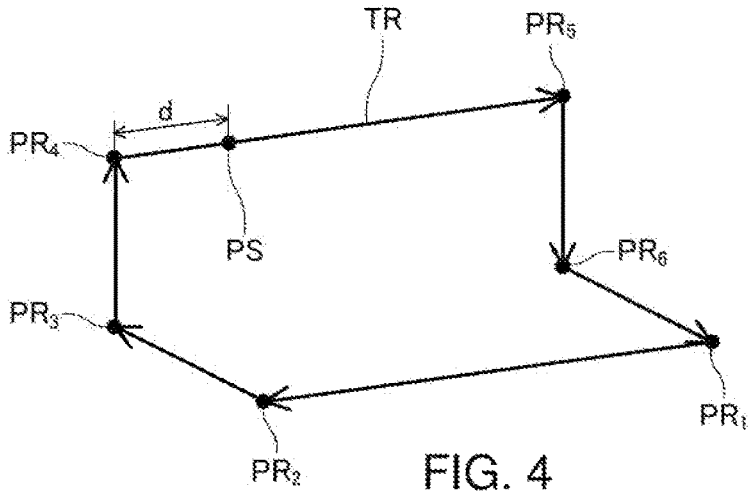
FIG. 4 is a diagram for explaining setting of a switching point.

In the present embodiment, the user can set the switching point of the timing switch by designating the reference point PR and designating the distance from the designated reference point PR. For example, as illustrated in FIG. 4, when setting the switching point PS of the timing switch (for example, the point for switching the timing switch to on) at a position on the trajectory TR during the advance motion (between the reference point $PR_4$ which is the start point of the advance motion and the reference point PRs which is the start point of the down motion), by designating the reference point $PR_4$ and designating the predetermined distance d from the designated reference point $PR_4$ to the switching point PS, the user can set the switching point PS at the position on the trajectory TR that is separated from the reference point $PR_4$ by the distance d along the trajectory TR, and can output an on signal to the external device at a timing when the transfer bar 11 reaches the switching point PS.

Figure 5:
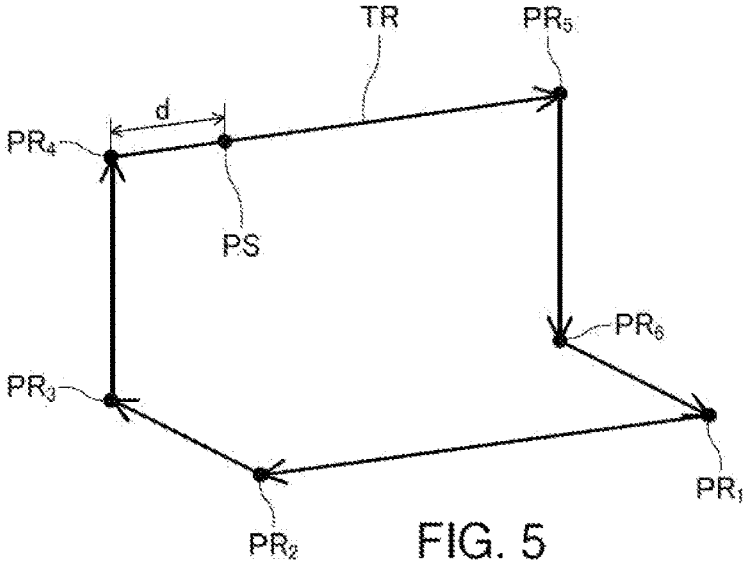
FIG. 5 is a diagram for explaining setting of a switching point.

As described above, according to the present embodiment, since the switching point PS of the timing switch can be set by designating the distance d from the reference point PR (any of $PR_1$ to $PR_6$) on the trajectory TR of the transfer bar 11 without using the press angle, the switching point PS of the timing switch can be easily and intuitively set while adjusting the timing in consideration of the movement of the transfer bar 11. In addition, by setting the point at which the motion of the transfer bar 11 is changed as the start point (reference point PR) of the distance d for setting the switching point PS, even when the transfer motion is changed, basically it is unnecessary to change the set value (designated distance) of the switching point PS, and the convenience of the user can be improved. For example, even when the lift stroke (moving distance in the Z-axis direction) of the transfer motion illustrated in FIG. 4 is increased and changed to the lift stroke of the transfer motion illustrated in FIG. 5, the position of the switching point PS separated from the reference point $PR_4$ by the distance d does not change. Therefore, it is not necessary to change the set value of the switching point PS.

Figure 6:
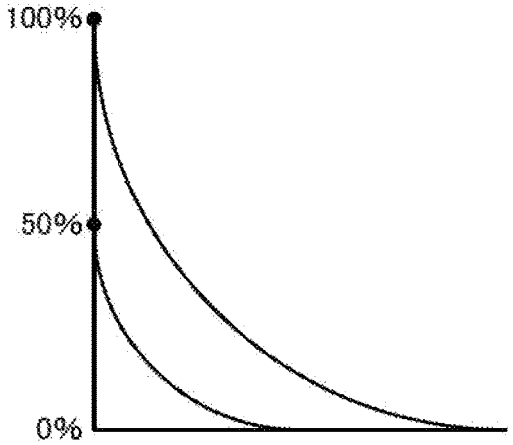
FIG. 6 is a diagram for explaining an overlap section.

Here, the total distance of the trajectory TR of the transfer bar 11 is not necessarily the sum of distances of the advance motion and the return motion in the X-axis direction (twice the feed stroke), distances of the clamp motion and the unclamp motion in the Y-axis direction (twice the clamp stroke), and distances of the lift motion and down motion in the Z-axis direction (twice the lift stroke). This is because, as illustrated in FIG. 3, in the transfer motion, it is possible to set an overlap section in which the transfer bar 11 is moved in the first direction and the second direction at the same time (the movement in the second direction is started before the movement in the first direction is completed) among the feed direction (X-axis direction), the clamp direction (Y-axis direction), and the lift direction (Z-axis direction). Specifically, it is possible to set the overlap section in which the transfer bar moves in the Y-axis direction and the X-axis direction at the same time by starting the return motion before the unclamp motion is completed, the overlap section in which the transfer bar moves in the X-axis direction and the Y-axis direction at the same time by starting the clamp motion before the return motion is completed, the overlap section in which the transfer bar moves in the Y-axis direction and the Z-axis direction at the same time by starting the lift motion before the clamp motion is completed, the overlap section in which the transfer bar moves in Z-axis direction and X-axis direction at the same time by staring the advance motion before the lift motion is completed, the overlap section in which the transfer bar moves in the X-axis direction and Z-axis direction at the same time by starting the down motion before the advance motion is completed, and the overlap section in which the transfer bar moves in the Z-axis direction and the Y-axis direction at the same time by starting the unclamp motion before the down motion is completed. The length of the overlap section (overlap amount) can be expressed as a percentage for the range in which the overlap section can be set, as illustrated in FIG. 6.

Figure 7:
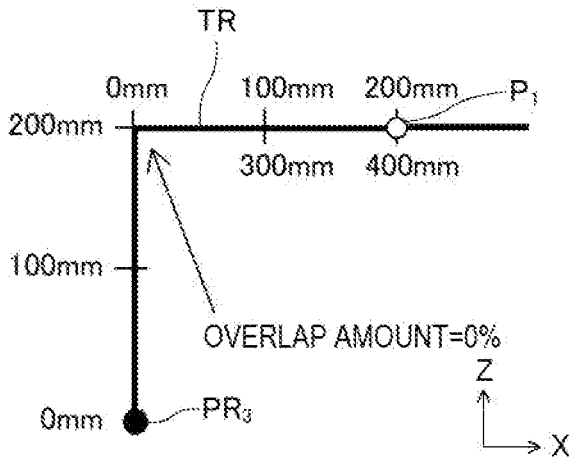
FIG. 7 is a diagram for explaining an overlap section.
Figure 8:
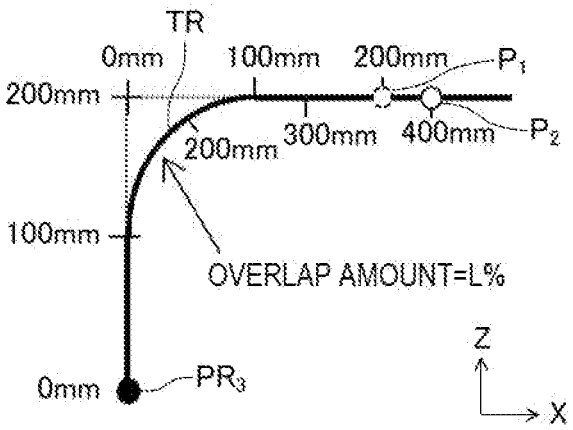
FIG. 8 is a diagram for explaining an overlap section.
Figure 9:
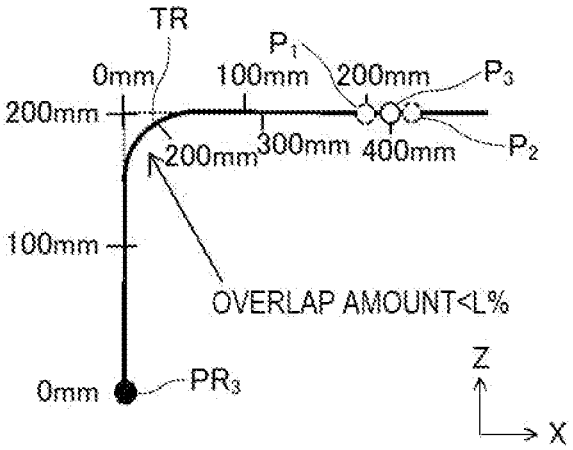
FIG. 9 is a diagram for explaining an overlap section.
Figure 10:
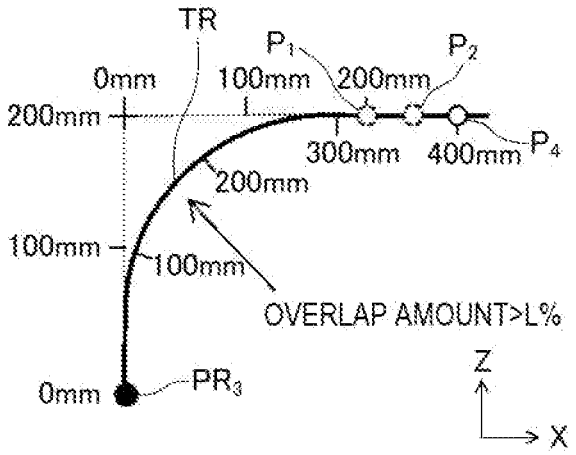
FIG. 10 is a diagram for explaining an overlap section.

When the overlap section is set, the distance on the trajectory TR of the transfer bar 11 that goes over the overlap section is shorter than the distance on the trajectory TR of the transfer bar 11 that does not go over the overlap section (when the overlap amount is 0%). For example, as illustrated in FIG. 7, in a case that the lift stroke is 200 mm, in the transfer motion when the end of the lift motion and the start of the advance motion do not overlap (overlap amount is 0%), a position 400 mm away from the reference point $PR_3$, which is the start point of the lift motion, along the trajectory TR is a point $P_1$. However as illustrated in FIG. 8, in the transfer motion when the end of the lift motion and the start of the advance motion overlap (overlap amount is L %), the position 400 mm away from the reference point $PR_3$ along the trajectory TR is a point $P_2$, which is downstream from the point $P_1$ in the transfer motion illustrated in FIG. 7. Further, as illustrated in FIG. 9, in the transfer motion when the overlap amount is larger than 0% and smaller than L %, the position 400 mm away from the reference point $PR_3$ along the trajectory TR is a point $P_3$, which is upstream from the point $P_2$ in the transfer motion illustrated in FIG. 8. Furthermore, as illustrated in FIG. 10, in the transfer motion when the overlap amount is larger than L %, the position 400 mm away from the reference point $PR_3$ along the trajectory TR is a point $P_4$, which is downstream from the point $P_2$. In this way, when the overlap amount is changed, the position of the point that is separated from the reference point PR by a predetermined distance along the trajectory TR and is on the axis different from the axis on which the reference point PR is located changes.

Figure 11:
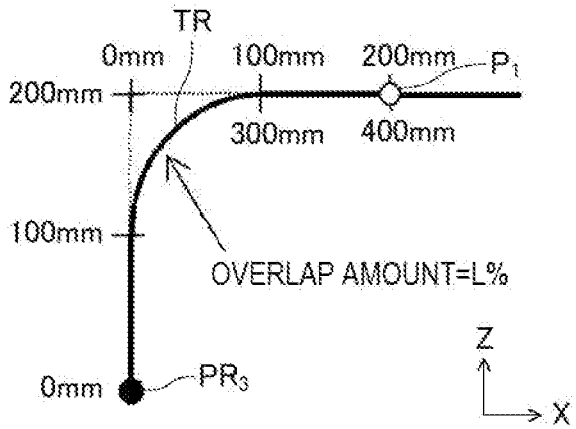
FIG. 11 is a diagram for explaining setting of a switching point when an overlap section is set between a reference point and a switching point.
Figure 12:
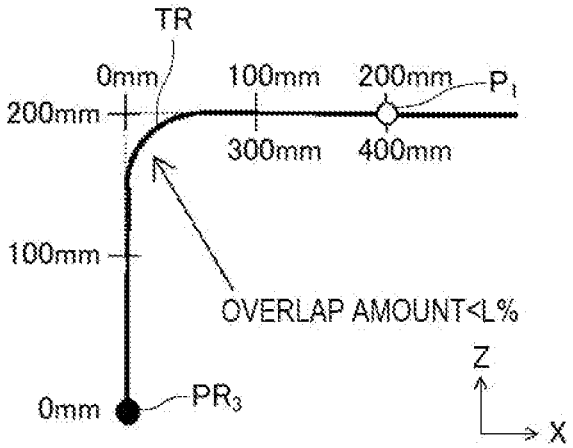
FIG. 12 is a diagram for explaining setting of a switching point when an overlap section is set between a reference point and a switching point.
Figure 13:
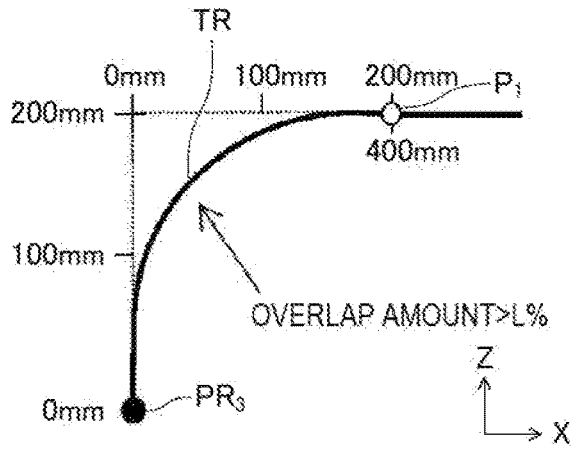
FIG. 13 is a diagram for explaining setting of a switching point when an overlap section is set between a reference point and a switching point.

Therefore, in the present embodiment, in the case that the overlap section is set between the reference point PR and the switching point PS, a point separated from the reference point PR by the designated distance (distance d) on the trajectory TR when the overlap section is not set (overlap amount is 0%) (along the trajectory TR when the overlap amount is 0%) is set as the switching point PS. For example, as illustrated in FIGS. 11 to 13, when the lift stroke is 200 mm, in a case that "400 mm from the reference point $PR_3$" is designated as the distance d for setting the switching point PS, even when the transfer motion is such that the end of the lift motion and the start of the advance motion overlap, the point $P_1$ 400 mm away from the reference point $PR_3$ on the trajectory TR when the end of the lift motion and the start of the advance motion do not overlap (trajectory TR illustrated in FIG. 7) is set as the switching point PS. The overlap amount is L % in FIG. 11, the overlap amount is larger than 0% and smaller than L % in FIG. 12, and the overlap amount is larger than L % in FIG. 13, but in any of these cases, the point $P_1$ set as the switching point PS is at the same position. In this way, in the case that the overlap section is set between the reference point PR and the switching point PS, even when the overlap amount is changed, it is not necessary to change the set value (designated distance) of the switching point PS of the timing switch.

Note that when the reference point PR is within the overlap section (the section in which the transfer bar 11 starts the motion in the second direction before completing the motion in the first direction), a point on the trajectory TR that is separated from the reference point PR by the designated distance (distance d) in the second direction is set as the switching point PS. For example, in the example illustrated in FIG. 14, there is the reference point PR within the overlap section (start point of the overlap section) in which the motion in the α-axis direction (second direction) is started before the motion in the β-axis direction (first direction) is completed. In this example, for instance, when "25 mm from the reference point PR" is designated as the distance d for setting the switching point PS, a point $P_5$ on the trajectory TR 25 mm away from the reference point PR in the α-axis direction is set as the switching point PS (the α-axis coordinate value of the switching point PS is set to 25 mm). Similarly, when "50 mm from the reference point PR" is designated as the distance d for setting the switching point PS, a point $P_6$ on the trajectory TR 50 mm away from the reference point PR in the α-axis direction is set as the switching point PS. Here, the point at which the overlap section ends is a point $P_7$ that is 100 mm away from the reference point PR in the α-axis direction, but the same applies when the distance d exceeds 100 mm. For example, when "200 mm from the reference point PR" is designated as the distance d, a point $P_8$ on the trajectory TR 200 mm away from the reference point PR in the α-axis direction is set as the switching point PS.

Further, when the switching point PS is set within the overlap section (the section in which the transfer bar 11 starts the motion in the second direction before completing the motion in the first direction), a point on the trajectory TR that is separated from the reference point PR on the axis in the first direction by the designated distance (distance d) in the first direction is set as the switching point PS. In the example illustrated in FIG. 15, the overlap section is set in which the motion in the β-axis direction (second direction) is started before the motion in the α-axis direction (first direction) is completed, the stroke length in the α-axis direction is 200 mm, and a point at which the overlap section ends is a point $P_9$ 300 mm away from the reference point PR on the trajectory TR when the overlap section is not set. In this example, when the designated distance is less than 200 un (stroke length in the α-axis direction), a point on the trajectory TR that is separated from the reference point PR by a designated distance in the α-axis direction is set as the switching point PS. For example, when "150 mm from the reference point PR" is designated as the distance d, a point $P_{10}$ on the trajectory TR 150 mm away from the reference point PR in the α-axis direction is set as the switching point PS (when the α-axis coordinate value of the reference point PR is 0, the α-axis coordinate value of the switching point PS is 150 mm). Similarly, when "175 mum from the reference point PR" is designated as the distance d, a point $P_{11}$ on the trajectory TR 175 mm away from the reference point PR in the α-axis direction is set as the switching point PS. Note that, when the designated distance is between 200 mm and 300 mm, the point $P_9$ at which the overlap section ends is set as the switching point PS.

Figure 14:
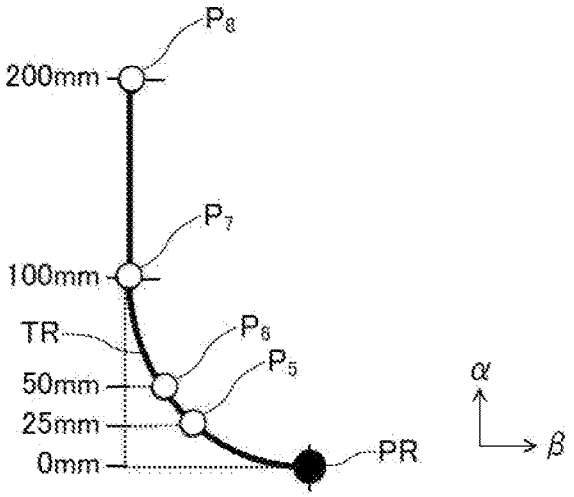
FIG. 14 is a diagram for explaining setting of a switching point when there is a reference point within an overlap section.
Figure 15:
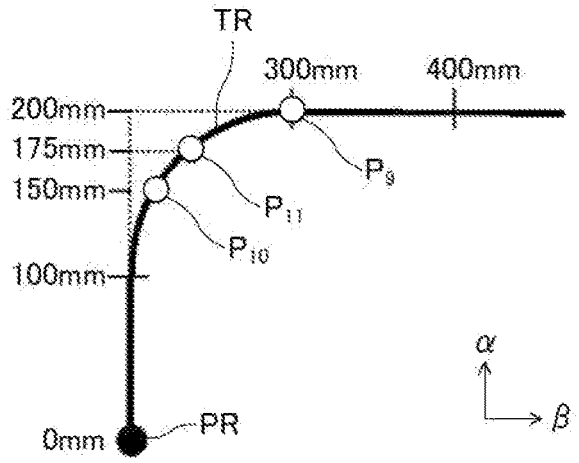
FIG. 15 is a diagram for explaining setting of a switching point when there is a switching point within an overlap section.

As described above, the switching point PS of the timing switch can be set in conjunction with the transfer motion by designating the distance d from the reference point PR in any case in which there is no overlap section (FIG. 7), the reference point PR and the switching point PS are set outside the overlap section (FIGS. 11 to 13), and the reference point PR or the switching point PS is set within the overlap section (FIG. 14 or 15).

Figure 16:
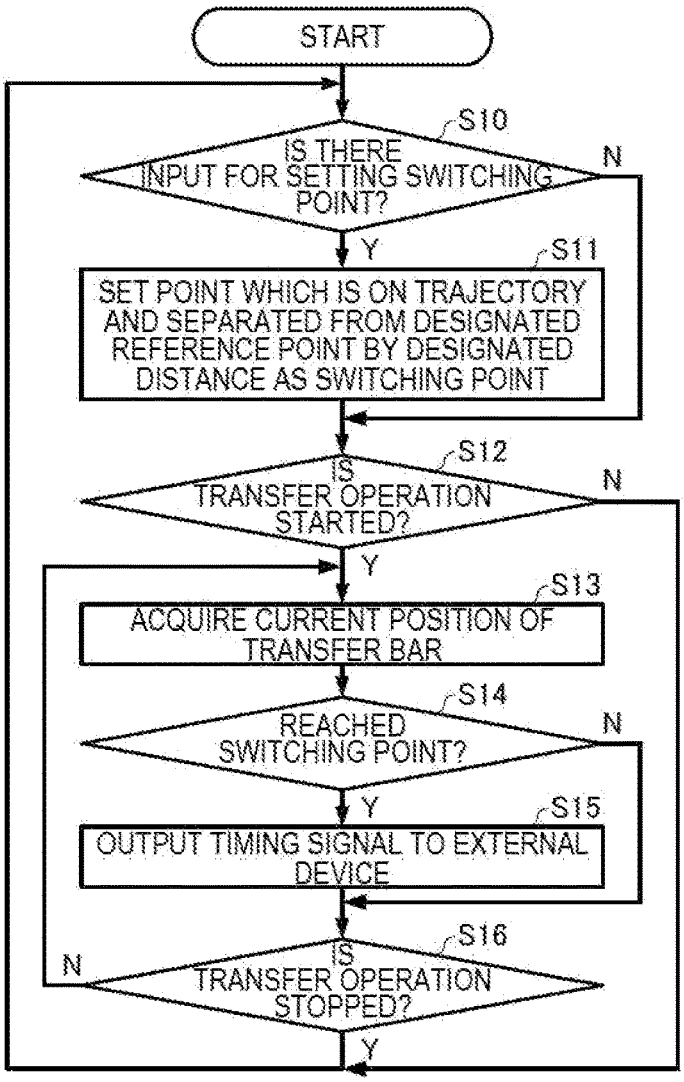
FIG. 16 is a flowchart illustrating a flow of processing by a setting unit and a signal output unit.
Figure 17:
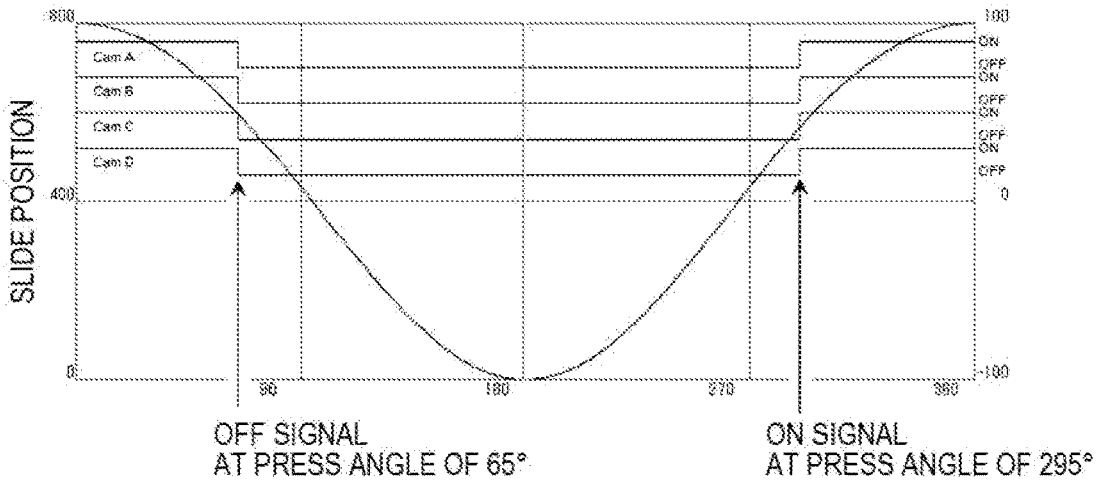
FIG. 17 is diagram for explaining a conventional example.

FIG. 16 is a flowchart illustrating a process of the setting unit 28 and the signal output unit 29. First, the setting unit 28 determines whether there is input for setting the switching point PS (input for designating the distance d and the reference point PR that is the start point of the distance d) (step S10). When the input for setting the switching point PS is made (Y in step S10), the point on the trajectory TR that is separated from the reference point PR designated by the input by the distance d designated by the input is set as the switching point PS (step S11). In step S11, in the case that the overlap section (the section in which the motion in the second direction is started before the motion in the first direction is completed) is set between the reference point PR and the switching point PS, the setting unit 28 sets the point on the trajectory TR that is separated from the reference point PR by the distance d using the trajectory TR when the overlap amount is 0% as the switching point PS. In the case that the reference point PR is within the overlap section, the setting unit 28 sets the point on the trajectory TR that is separated from the reference point PR by the distance d in the second direction as the switching point PS. In the case that the switching point PS is set within the overlap section, the setting unit 28 sets the point on the trajectory TR that is separated from the reference point PR by the distance d in the first direction is set as the switching point PS.

Next, it is determined whether the transfer operation is started (step S12). When the transfer operation is started (Y in step S12), the signal output unit 29 acquires the current position of the transfer bar 11 (position on the trajectory TR) based on the signal from the servo transfer control device 25 or the like (step S13). Next, based on the acquired current position, the signal output unit 29 determines whether the transfer bar 11 reaches the switching point PS set in step S11 (step S14). When the transfer bar 11 reaches the switching point PS (Y in step S14), the signal output unit 29 outputs the timing signal TS to the external device (step S15). Next, it is determined whether the transfer operation is stopped (step S16). When the transfer operation is continued (N in step S16), the process proceeds to step S13. When the transfer operation is stopped (Y in step S16), the process proceeds to step S10.

Some embodiments of the invention have been described in detail above, but a person skilled in the art will readily appreciate that various modifications can be made from the embodiments without materially departing from the novel teachings and effects of the invention. Accordingly, all such modifications are assumed to be included in the scope of the invention.

What is claimed is:

1. A transfer device that transfers a workpiece by a transfer motion which is based on a transfer individual phase signal synchronized with a master phase signal, the transfer device comprising:

a setting unit that sets a point on a trajectory of a transfer bar as a switching point of a timing switch, the point on the trajectory being separated from a reference point on the trajectory by a designated distance designated by a user, and the trajectory being based on the transfer motion; and a signal output unit that outputs a timing signal to an external device at a timing when the transfer bar reaches the switching point.

2. The transfer device according to claim 1, wherein the transfer motion is formed of a combination of an unclamp motion, a return motion, a clamp motion, a lift motion, an advance motion, and a down motion of the transfer bar, and the reference point is a point at which a motion of the transfer bar is changed.

3. The transfer device according to claim 2, wherein when an overlap section in which the transfer bar moves in a first direction and a second direction among a feed direction, a clamp direction, and a lift direction at the same time by starting a motion in the second direction before completing a motion in the first direction is set between the reference point and the switching point, the setting unit sets a point separated from the reference point by the designated distance on the trajectory when the overlap section is not set as the switching point.

4. The transfer device according to claim 2, wherein when an overlap section is set in which the transfer bar moves in a first direction and a second direction among a feed direction, a clamp direction, and a lift direction at the same time by starting a motion in the second direction before completing a motion in the first direction, and the reference point is within the overlap section, the setting unit sets a point which is on the trajectory and separated from the reference point by the designated distance in the second direction as the switching point.

5. The transfer device according to claim 2, wherein when an overlap section is set in which the transfer bar moves in a first direction and a second direction among a feed direction, a clamp direction, and a lift direction at the same time by starting a motion in the second direction before completing a motion in the first direction, and the switching point is set within the overlap section, the setting unit sets a point which is on the trajectory and separated from the reference point by the designated distance in the first direction as the switching point.

6. A method for controlling a transfer device that transfers a workpiece by a transfer motion which is based on a transfer individual phase signal synchronized with a master phase signal, the method comprising:

a setting step that sets a point on a trajectory of a transfer bar as a switching point of a timing switch, the point on the trajectory being separated from a reference point on the trajectory by a designated distance designated by a user, and the trajectory being based on the transfer motion; and a signal output step that outputs a timing signal to an external device at a timing when the transfer bar reaches the switching point.

* * * * *